US008157351B2

(12) United States Patent
Toyama et al.

(10) Patent No.: US 8,157,351 B2
(45) Date of Patent: Apr. 17, 2012

(54) INKJET PRINTING APPARATUS AND INKJET PRINTING METHOD

(75) Inventors: Noboru Toyama, Kawasaki (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 419 days.

(21) Appl. No.: 12/423,603

(22) Filed: Apr. 14, 2009

(65) Prior Publication Data

US 2009/0256871 A1 Oct. 15, 2009

(30) Foreign Application Priority Data

Apr. 15, 2008 (JP) ..... 2008-106078

(51) Int. Cl.
*B41J 2/15* (2006.01)
*B41J 2/145* (2006.01)

(52) U.S. Cl. ..... 347/41

(58) Field of Classification Search ..... None
See application file for complete search history.

(56) References Cited

U.S. PATENT DOCUMENTS 5,594,478 A 1/1997 Matsubara et al.
5,604,520 A 2/1997 Matsubara et al.
5,633,663 A 5/1997 Matsubara et al.
6,130,685 A 10/2000 Matsubara et al.
6,250,737 B1 6/2001 Matsubara et al.
6,257,699 B1 * 7/2001 Tracy et al. ..... 347/40
7,085,002 B2 8/2006 Ilbery et al.
7,152,950 B2 12/2006 Takekoshi et al.
7,538,909 B2 5/2009 Ilbery et al.
2003/0128263 A1 * 7/2003 Han-Adebekun et al. .... 347/101
2005/0168507 A1 * 8/2005 Ide et al. ..... 347/12

* cited by examiner

*Primary Examiner* — Stephen Meier
*Assistant Examiner* — Tracey McMillion
(74) *Attorney, Agent, or Firm* — Fitzpatrick, Cella, Harper & Scinto

(57) ABSTRACT

There is provided an inkjet printing apparatus which are used to obtain a printed matter having a small degree of glossiness unevenness and a flat surface. The apparatus is the inkjet printing apparatus for forming an image on a print medium by relatively scanning a first ejection unit for ejecting a first ink and a second ejection unit for ejecting a second ink to the print medium. The apparatus includes forming unit configured to form the image with the first and second inks on the print medium in each of a first printing mode for completing an image by scanning the first ejection unit one time and a second printing mode for completing an image by scanning the second ejection unit plural times. A gloss value of a solid image with the second ink is greater than a gloss value of a solid image with the first ink.

3 Claims, 11 Drawing Sheets

INKJET PRINTING APPARATUS AND INKJET PRINTING METHOD

FIELD OF THE INVENTION

The present invention relates to an inkjet printing apparatus and an inkjet printing method.

DESCRIPTION OF THE RELATED ART

Inkjet printing apparatuses include line-type printing apparatuses and serial-type printing apparatuses. The serial-type apparatus performs main-scanning and sub-scanning. In the main scanning, the apparatus moves a printing head relative to a print medium while causing the printing head to eject an ink. In the sub-scanning, the apparatus feeds a print medium by a predetermined amount in a direction orthogonal to a main scanning direction. The serial-type apparatus serially forms an image on the print medium by alternately repeating the main scanning and the sub-scanning.

Some of the serial-type printing apparatuses employ a multi-scan print mode in order to improve quality of images. In the multi-scan print scheme, while a printing medium having a width smaller than that of a range of an array of printing elements is transferred, the printing head performs main scanning of the printing medium plural times so as to complete the printing of an image in a predetermined region (for example a single pixel array region) on the print medium.

For the execution of the multi-scan scheme, image data to be printed in the predetermined region needs to be divided into plural image data corresponding to the plural times of main scanning. Conventionally, masks have been used for such division. A mask is, as publicly known, an aggregate of data in which data allowing image data to be printed thereon (data for not masking the image data) and data not allowing image data to be printed thereon (data for masking the image data) are previously arrayed. Then, by executing AND operations of such masks and the binary image data to be printed on the predetermined region, the binary image data to be printed on the predetermined region is divided into the plural image data corresponding to the respective times of the scanning.

Meanwhile, a dye-based ink or a pigment ink is used in an inkjet printing apparatus. The use of the pigment ink contributes to improvement of various properties needed for a printed image, such as a density, a definition, and image durability such as water resistance and light resistance.

In the case of pigment inks, however, gloss values may vary with the color and printing method in some cases. For example, in a case where an image is printed by the multi-scan printing mode by use of a cyan ink having a relatively great gloss value and a yellow ink having a relatively small gloss value, there may occur glossiness unevenness in some cases due to a gloss value difference between the cyan and yellow inks. That is, since a gloss value of a part printed with the cyan ink is greater than that of a part printed with the yellow ink, glossiness unevenness occurs due to a difference between these gloss values.

In order to reduce such glossiness unevenness as described above, there has been known a technique in which a printing rate in the last time of scanning with an ink having a relatively small glass value is set greater than a printing rate in the last time of scanning with an ink having a relatively great gloss value (for example, refer to Description of U.S. Pat. No. 7,152,950). According to this technique, an ink having a relatively small gloss value is more likely to be positioned in an outermost layer, and therefore, a dominant color of inks in an outermost layer is uniformed in an image of secondary or higher order color is uniformed, whereby glossiness unevenness is reduced.

However, the above described technique aims to reduce glossiness unevenness in an image of a secondary or higher order color obtained by inks of plural colors printed overlaying one another, and is thus insufficient for reducing glossiness unevenness occurring between single-color images respectively printed with inks of plural colors. That is, although the above described technique reduces glossiness unevenness by uniforming a dominant color of the outermost layer inks, the above technique cannot uniform a dominant color of the outermost layer inks of one color image of one color and another single color image of another color. Accordingly, even if the technique disclosed in the above patent document is employed, glossiness unevenness occurring between single-color images respectively printed with different colors cannot be reduced. Additionally, even in a case of an image of a secondary or higher order color, glossiness unevenness cannot be reduced by the above described technique if printing rates of inks with different glossiness unevennesses widely differ from each other.

SUMMARY OF THE INVENTION

The present invention was made in consideration of the above points, and provides an inkjet printing apparatus and inkjet printing method which are used to obtain a printed matter having a small degree of glossiness unevenness, when an image is printed by use of plural colors of inks having different gloss values.

In order to achieve the above object, the present invention is an inkjet printing apparatus for forming an image on a print medium by relatively scanning to the print medium a first ejection unit for ejecting a first ink and a second ejection unit for ejecting a second ink different in kind from the first ink. The inkjet printing apparatus is characterized by including a forming unit configured to form the image with the first and second inks on the print medium by a first printing mode for completing an image to be printed with the first ink to a pixel array region on the print medium by scanning the first ejection unit one time and a second printing mode for completing an image to be printed with the second ink to the pixel array region on the print medium by scanning the second ejection unit plural times, and is characterized in that a gloss value of a solid image with the second ink is greater than a gloss value of a solid image with the first ink.

According to the above configuration, by respectively printing inks having different gloss values by different printing modes, glossiness unevenness occurring due to gloss value differences between the inks can be reduced. Thereby, a printed matter having a small degree of glossiness unevenness can be obtained.

Further features of the present invention will become apparent from the following description of exemplary embodiments (with reference to the attached drawings).

DESCRIPTION OF THE EMBODIMENTS

Embodiments according to the present invention will be described in detail below with reference to the drawings.

First Embodiment

Figure 1:
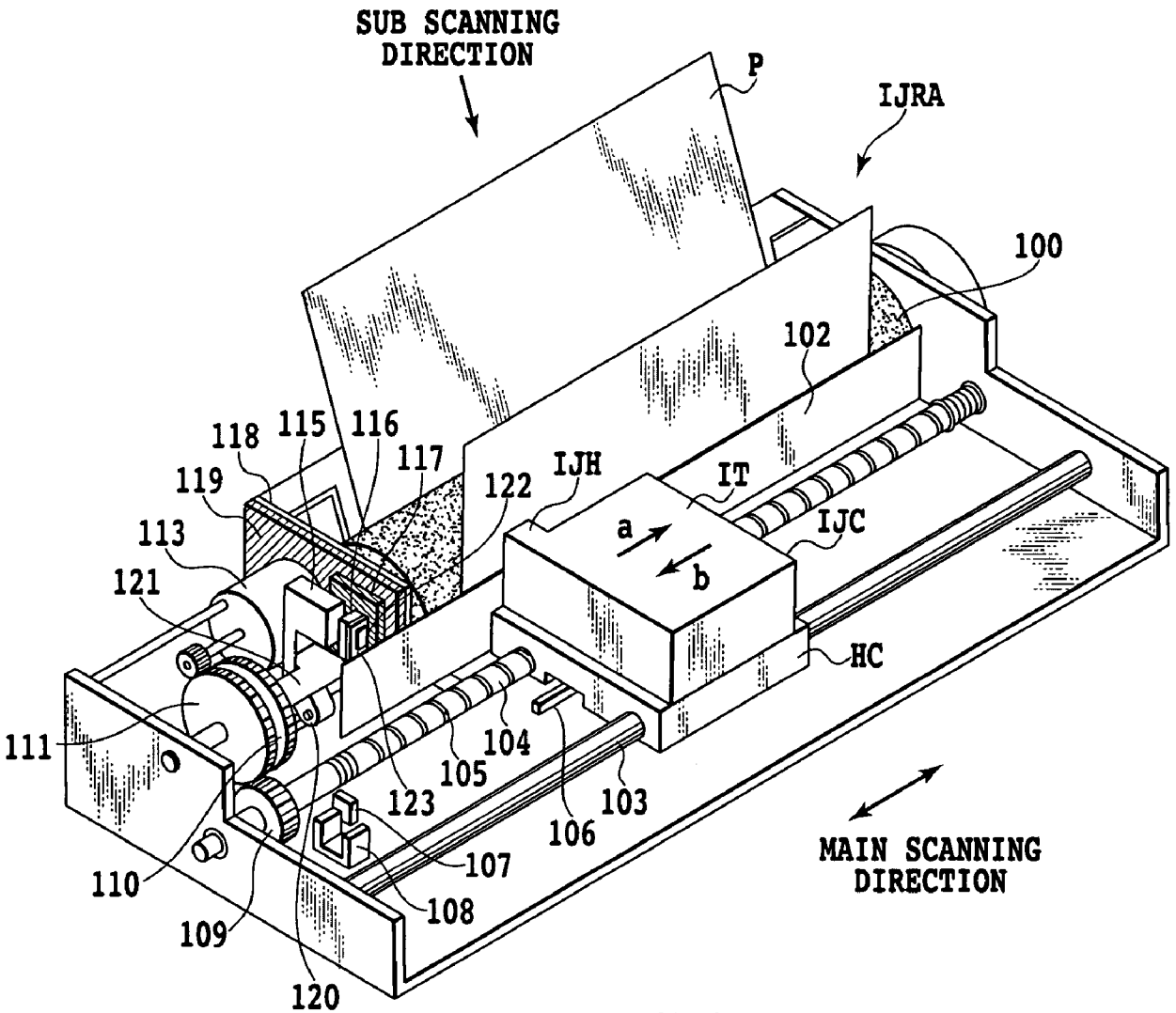
FIG. 1 is a perspective view showing a configuration of an inkjet printing apparatus in an embodiment of the present invention.

FIG. 1 is a perspective view showing an inkjet printing apparatus IJRA that is a printing apparatus applicable to this embodiment.

A carriage HC engages with a helical groove 104 of a lead screw 105, the lead screw 105 configured to move in synchronization with a forward and reverse rotations of a drive motor 113 and to rotate through driving force transmission gears 109 to 111. The carriage HC thus makes reciprocating movement in directions indicated by arrows a and b (in main scanning directions) while being supported by a guide rail 103. The carriage HC has an integrated inkjet cartridge IJC mounted thereon, containing a printing head IJH and an ink tank IT. Note that, the ink tank IT and the printing head IJH are integrally formed so as to constitute a replaceable ink cartridge IJC in this embodiment. However, the ink tank IT and the printing head IJH may be separated from each other.

A paper pressing plate 102 presses a print medium P against a platen 100 along a moving direction of the carriage HC. Photocouplers 107 and 108 identify existence of a lever 106 of the carriage, and detects a home position at which rotational directions of the motor 113 is switched or which is used for other purposes.

In this embodiment, the ink tanks IT contain a cyan ink (BCI-1421 C) and a yellow ink (BCI-1421 Y) at least. As will be described later by use of FIG. 4, the cyan ink in this embodiment is an ink having a greater gloss value than the yellow ink.

A capping member 122 that caps a front face of the printing head IJH is supported by a member 116, and performs suction-based recovery of the printing head through an aperture 123 inside a cap by use of a suction apparatus 115 that sucks the inside of a cap. A cleaning blade 117 is moved frontward and backward by a member 119. The cleaning blade 117 and the member 119 are supported by a main body supporting plate 118. Additionally, the lever 121 is provided for starting suction of the suction-based recovery, and moves along with movement of a cum 120 engaging with the carriage. The movement of the lever 121 is controlled by a driving force from the drive motor, the driving force transmitted by a publicly known transmission mechanism such as clutch switching. Note that a configuration of the printing apparatus according to the present invention is fine as far as it allows desired operations of capping, cleaning and suction-based recovery to be performed at known timings.

Figure 2:
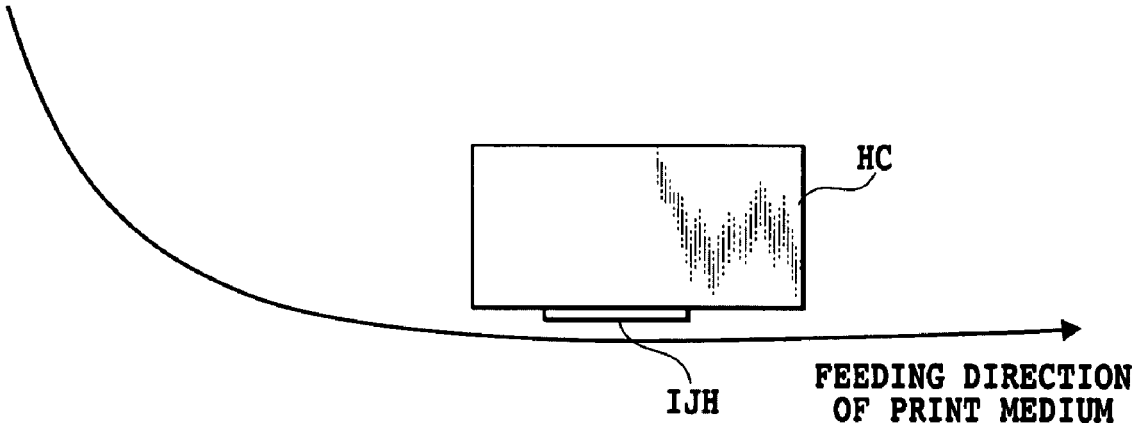
FIG. 2 is a schematic view showing configurations of an inkjet printing apparatus and a periphery thereof in a first embodiment of the present invention.

FIG. 2 is a schematic view showing a periphery of a printing unit of the printing apparatus in this embodiment. Inside the carriage HC, plural inkjet cartridges IJC are set, and ink droplets are ejected from the head IJH to a print medium in accordance with image data. The carriage HC moves in the print main scanning directions (main scanning directions) substantially orthogonal to a transferring direction of a paper. The print medium is transferred by a predetermined amount in an arrowed direction (the sub scanning direction) shown in FIG. 2. Images are serially printed on the print medium by alternately repeating the movement of this carriage in the main scanning directions, and the transferring of the print medium in the sub scanning direction.

Figure 3:
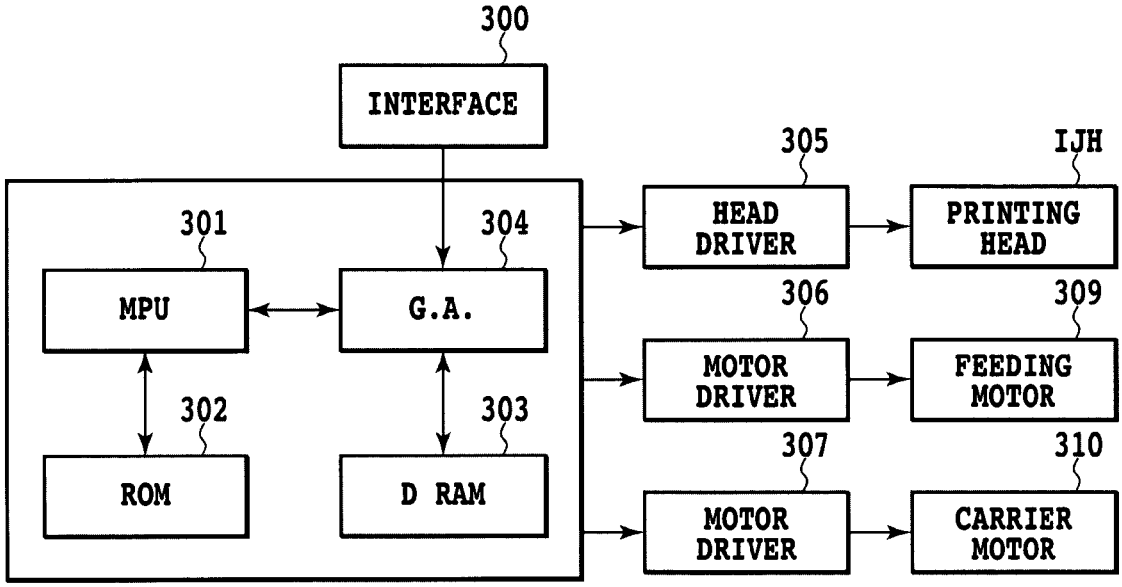
FIG. 3 is a block diagram showing a control configuration of the inkjet printing apparatus in the first embodiment of the present invention.

FIG. 3 a block diagram showing a configuration of a control circuit of the inkjet printing apparatus. Reference numeral 300 denotes an interface to which a print start signal, image data and the like are inputted, which are transmitted from an external apparatus (a computer or the like) connected to the printing apparatus. Reference numeral 301 denotes an MPU that controls an entire printing apparatus, reference numerals 302 denotes a ROM, and Reference numerals 303 denotes a DRAM in which various data (such as a print start signal, image data and the like) are stored. In the ROM 302, a control program executed by the MPU 301 is stored. The MPU 301 executes: data processing according to later-described printing modes (a first printing mode, a second printing mode and the like); setting of a printing mode dependent on kinds of inks; selection of a printing mode according to amounts (dot count values) of various inks to be used for image formation; or the like. For example, in a case where the second printing mode (a multi-scan printing mode) is set or selected, the MPU 301 reads out a mask previously stored in the ROM, and, by AND processing (AND operation) of this mask and image data, generates image data to be printed with each pass of multiple scanning passes. Agate array (G. A.) 304 performs data supply control on the printing head IJH, and data transfer control among the interface 300, the MPU 301 and the RAM 303. Reference numerals 310 and 309 denote a carrier motor used for moving the printing head IJH in the main scanning directions, and a transferring motor for transferring print paper in the sub scanning direction, respectively. Reference numeral 305 denotes a head driver for driving the printing head, reference numeral 306 denotes a motor driver for driving the carriage motor 309, and reference numeral 307 denotes a motor driver used for driving the carriage motor 310.

When image data is inputted to the interface 300, the image data is converted into print-use data between the G. A. 304 and the MPU 301. The print-use data is temporarily stored in the DRAM 303 until it accumulates to a level, high enough to start driving of the printing head. Then, the printing head is driven in accordance with the print-use data having been transmitted to the head driver 305 at the same time as the motor drivers 306 and 307 are driven, whereby printing is performed.

The printing apparatus in this embodiment is configured so as to be capable of executing at least two printing modes (the first printing mode and the second printing mode). The "first printing mode" is a printing mode in which the printing head scans one pixel array region (a raster region) one time, and will be referred to as an interlace printing mode (an interlace mode) below in some cases. The "second printing mode" is a printing mode in which the printing head scans one pixel array region (a raster region) plural times, and will be referred to as a multi-scan print mode (a multi-scan mode) below in some cases.

Figure 4:
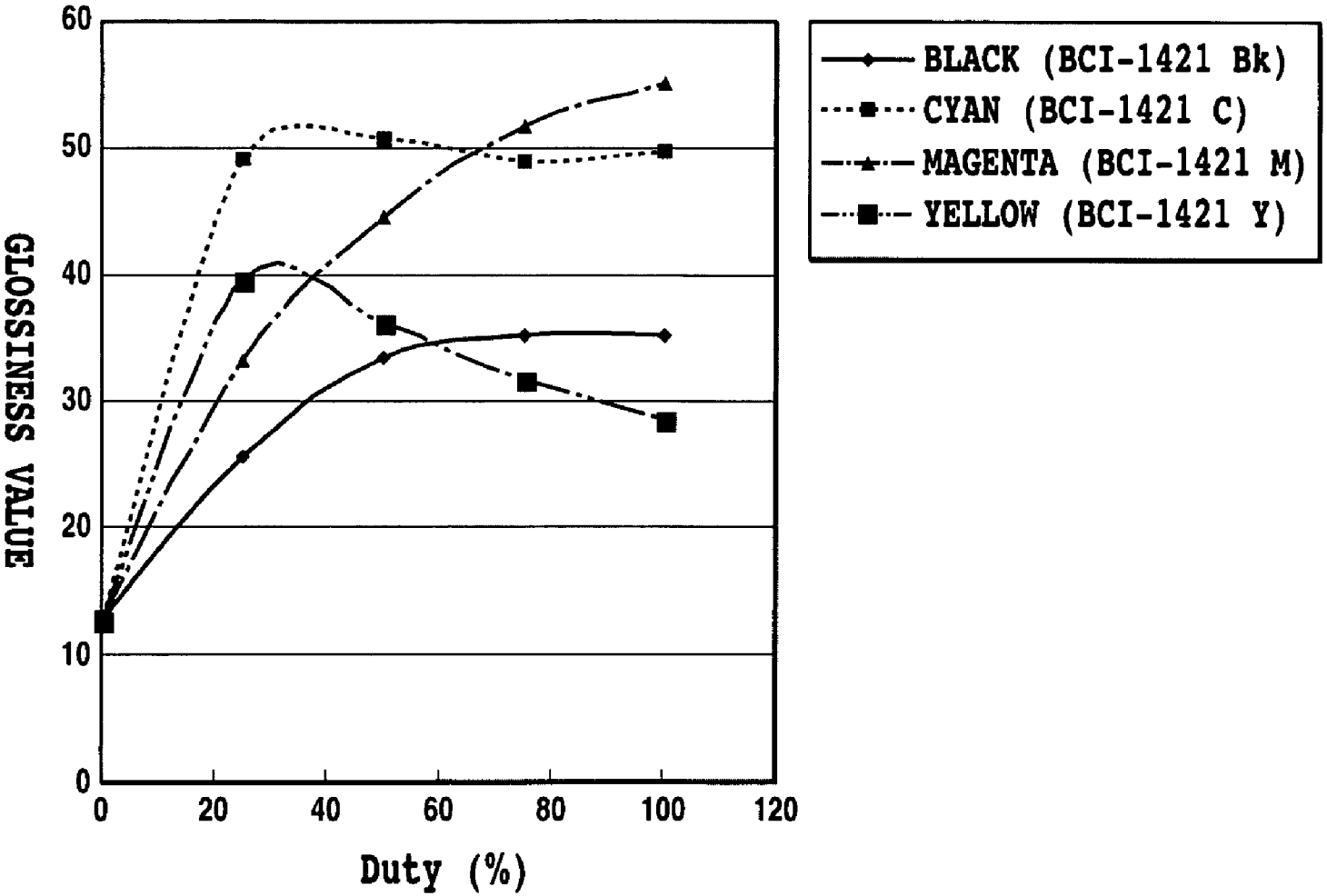
FIG. 4 is a graph showing printed results in the first embodiment of the present invention.

Next, gloss value differences among inks will be described. FIG. 4 is a graph showing a relationship between a printing duty and a gloss value for each of four inks. In this graph, the vertical axis indicates 20-degree gloss values and the horizontal axis indicates printing duties. The four inks used here are black (BCI-1421 Bk), cyan (BCI-1421 C), magenta (BCI-1421 M) and yellow (BCI-1421 Y) inks manufactured by Canon Inc. In accordance with multi-scan printing mode, printing was performed on a glossy paper LFM-GP421R at print duties of 25%, 50%, 75% and 100% by use of these four kinds of inks, and thus a total of 16 patches (4 color inks×4 duties) were formed. Results shown in FIG. 4 were obtained by measuring gloss values for the thus formed 16 patches. Note that a size of each patch was set to 3 cm by 3 cm. Additionally, a micro haze meter (manufactured by BYK Gardner) is used for the measurement of the gloss values, and an examination was made by use of 20-degree gloss values. A printer used for the formation of the patches is W8200 manufactured by Canon Inc.

Note that a print duty is a ratio of plural pixels (N pixels) constituting a unit region to pixels (M pixels) on which dots are actually printed, and is expressed by N/M×100(%). For example, if the number of pixels constituting the unit region is 100, and dots are printed on 25 of the 100 pixels, a print duty is 25% in the unit region. In like manner, a print duty is 100% in a case where dots are printed on all of the 100 pixels.

As shown in this graph, in general, a gloss value widely changes in accordance with a print duty, and a great-low relationship of gloss values between two inks may be reversed in accordance with the print duty. Accordingly, in order to exclusively define relative levels of gloss values, a print duty of images used for measurement of gloss values needs to be uniquely determined previously. Therefore, in this patent description, levels of gloss values are defined in accordance of gloss values at the measurement of solid images (solid patches) at a print duty of 100%. For example, considering the cyan ink and the yellow ink, a gloss value of the cyan ink when the print duty was 100% was about 50, and a gloss value of the yellow ink when the print duty was 100% was about 28. Consequently, in this case, the cyan ink corresponds to an ink having a relatively great gloss value, and the yellow ink corresponds to an ink having a relatively small gloss value. In this embodiment, the yellow (Y) and black (K) inks are set as inks having relatively small gloss values, and the magenta (M) and cyan (C) inks are set as relatively great gloss values.

Grouping of inks applicable to this embodiment is not limited to the above manner. Only the yellow ink may be set as an ink having a relatively small gloss value, the other three inks may be set inks having relatively great gloss values. Alternatively, in contrast, while only the magenta ink may be set as an ink having a relatively great gloss value, the other three inks may be set inks having relatively small gloss values. That is, the number of inks having relatively small gloss values may be one or plural, and, likewise, the number of inks having relatively great gloss values may be one or plural.

Figure 5:
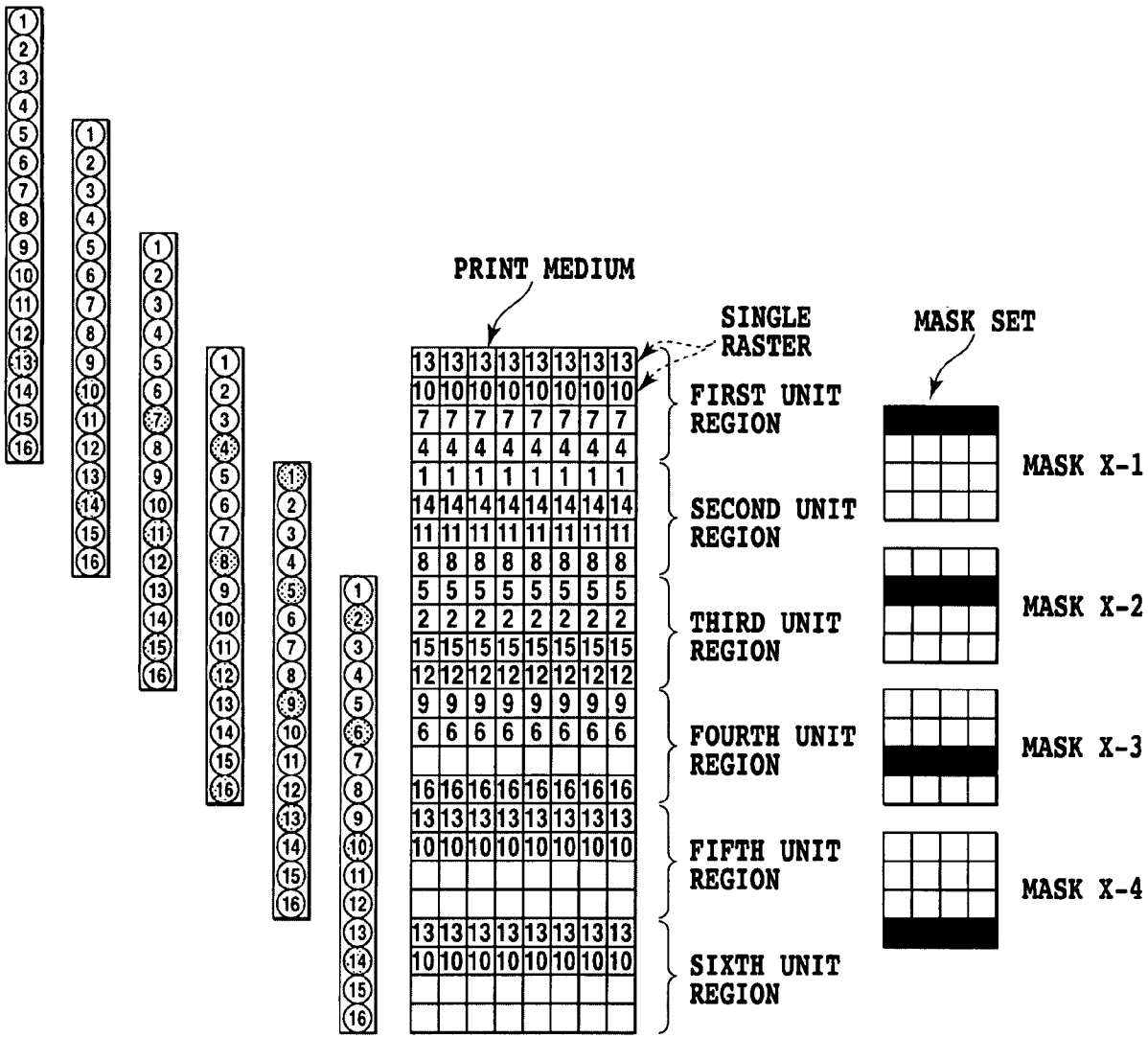
FIG. 5 is a diagram explaining a first printing mode (an interlace mode) in the first embodiment of the present invention.

Next, a printing method of this embodiment will be described. FIG. 5 is a diagram explaining the first printing mode (the interlace mode) in which an ink ejection unit scans one raster region (a pixel array region) one time to complete an image to be printed on the raster region. For printing with an ink (an ink of a first kind) having a relatively small gloss value, this interlace mode (the first printing mode) is used. Here, exemplified is a case where printing is performed under conditions in that: the number of nozzles of a first ejection unit used for ejecting an ink having a relatively small gloss value is 16; a print medium is transferred by a 4-nozzle width for each transferring; printing on a unit region of this 4-nozzle width is performed with four scanning passes; and printing one raster region is performed with one scanning pass.

In each of unit regions, a mask X-1 is used in the first pass, a mask X-2 is used in the second pass, a mask X-3 is used in the third pass, and a mask X-4 is used in the fourth pass. These masks are previously stored in the ROM 302, and are read out from the ROM when used.

In a first unit region, by using the mask X-1 in the first pass, printing is performed on one raster region through a nozzle of the nozzle number 13. By using the mask X-2 in the second pass, printing is performed on one raster region through a nozzle of the nozzle number 10. In like manners, by using the mask X-3 in the third pass, and by using the mask X-4 in the fourth pass, printing is performed on raster regions through nozzles of the nozzle number 7 and the nozzle number 4, respectively. By thus constraining the number of nozzles usable for printing on one raster region to only one, printing on one raster region is performed with one scanning pass. A dot image printed with one scanning pass has high surface flatness and smoothness, and tends to have a great gloss value. Accordingly, in order to obtain a great gloss value, it is preferable that the interlace mode such as one shown in FIG. 5 be used.

Figure 6:
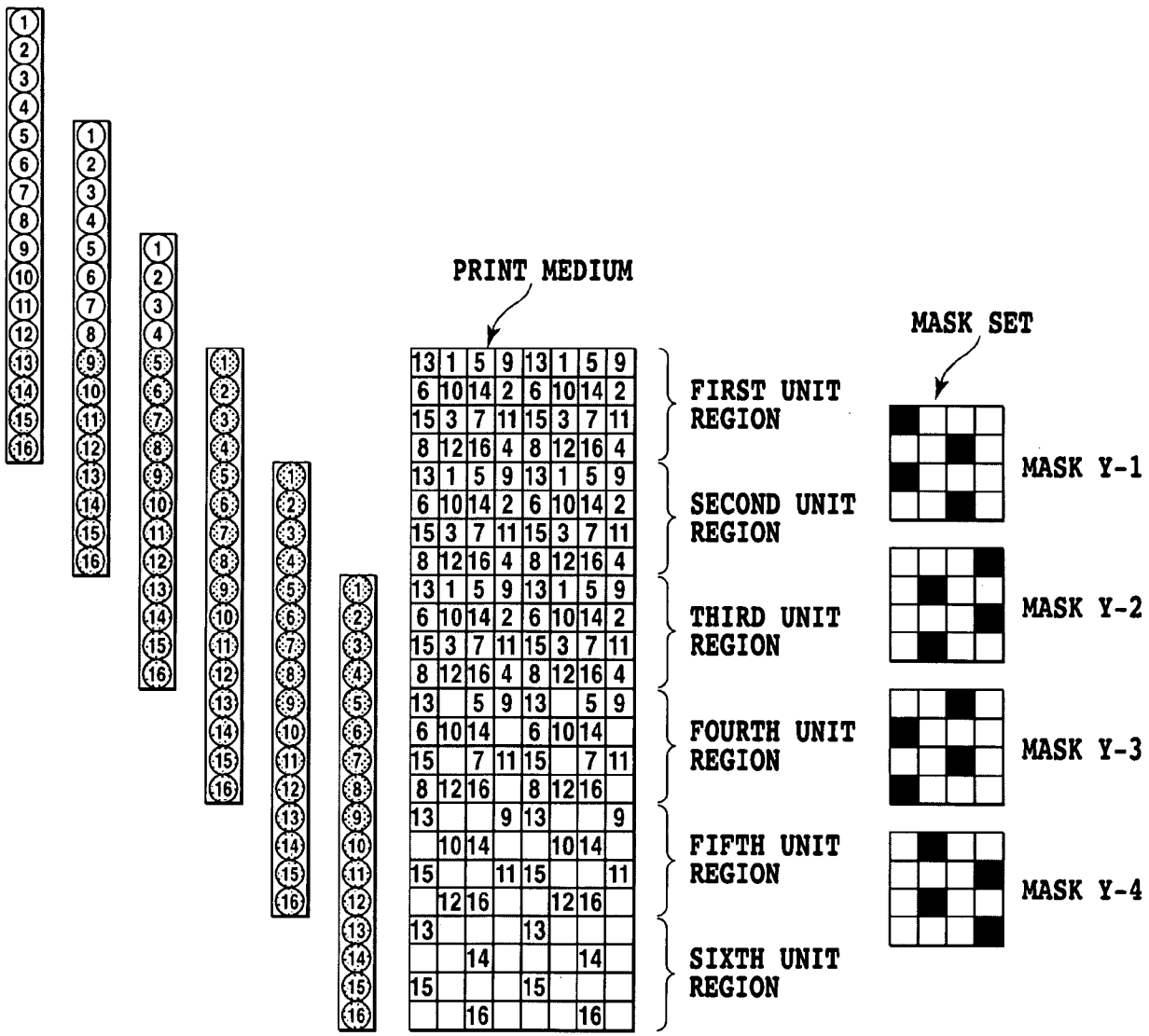
FIG. 6 is a diagram explaining a second printing mode (a multi-scan mode) in the first embodiment of the present invention.

FIG. 6 is a diagram explaining the second printing mode (the multi-scan mode) in which an ink ejection unit scans one raster region plural times to complete an image to be printed on the single raster region. For printing with an ink (an ink of a second kind) having a relatively great gloss value, this multi-scan mode (the second printing mode) is used. Here, exemplified is a case where printing is performed under conditions in that: the number of nozzles of a second ejection unit used for ejecting an ink having a relatively great gloss value is 16; a print medium is transferred by a 4-nozzle width for each transferring; printing on a unit region of this 4-nozzle width is performed with four scanning passes; and printing on one raster region is also performed with four scanning passes.

In each of unit regions, a mask Y-1 is used in the first pass, a mask Y-2 is used in the second pass, a mask Y-3 is used in the third pass, and a mask Y-4 is used in the fourth pass. These masks are previously stored in the ROM 302, and are read out from the ROM when used. By use of such masks as those, the number of nozzles usable for printing on one raster region is increased to 4, whereby printing on one raster region is executed with four scanning passes. A dot image printed with multiple scanning passes has lower surface flatness and smoothness, and tends to have a smaller gloss value, than the above dot image printed with one scanning pass. Accordingly, in the multi-scan mode shown in FIG. 6, a gloss value as high as one obtained in the interlace mode cannot be obtained. However, this multi-scan mode is advantageous in density unevenness reduction as compared to the interlace mode.

Figure 7:
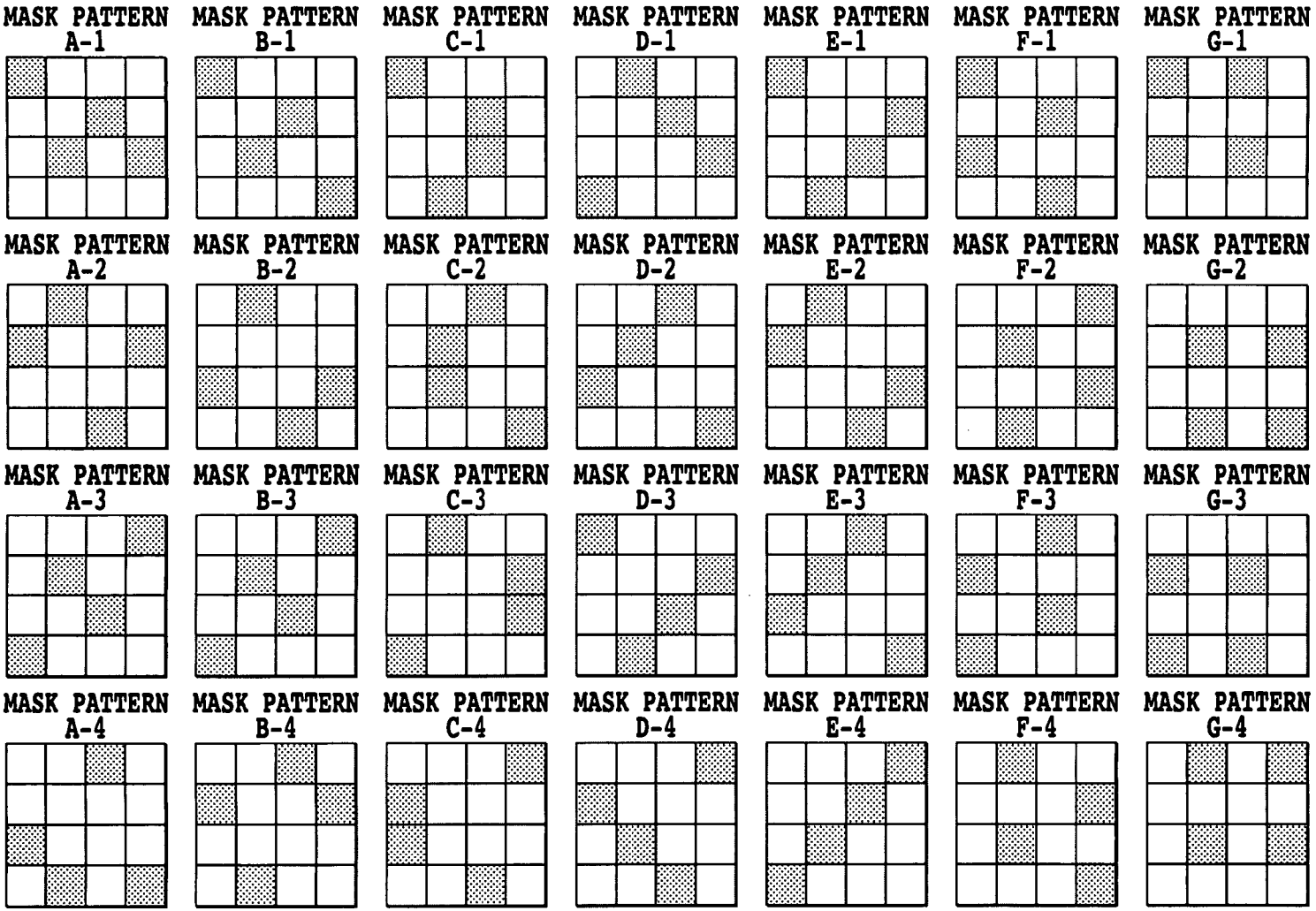
FIG. 7 is a diagram explaining other mask patterns applicable to the first embodiment of the present invention.

Although the same mask set (X-1 to X-4 or Y-1 to Y-4) is used for all of the unit regions in each of FIGS. 5 and 6 described above, different mask sets may be used in the respective unit regions. A case where mask sets are varied for the respective unit regions will be described below by use of FIG. 7. FIG. 7 is a diagram exemplifying other mask patterns usable in the second printing mode. In FIG. 7, seven sets A to G of mask patterns are shown. In the ROM 302, such plural sets of mask patterns as those are previously stored. Each of the sets A to G has four mask patterns, and 100% printing is possible with these four mask patterns belonging to the same set. That is, the four mask patterns belonging to the same set have a mutually complementary relationship thereamong, and a mask is formed by the four mask patterns each having its printing allowable rate at 25%. For example, for each of mask patterns A-1, A-2, A-3 and A-4, a rate of printing allowable pixels (parts filled in with black in the drawing) to all of pixels are determined as 25%.

One set is randomly selected from such plural mask sets for each unit region, and printing with four scanning passes is performed on the unit region by use of the selected one mask set.

More specifically, the MPU randomly selects one set from the plural mask sets stored in the ROM. The MPU sets, in the RAM, the thus selected mask set as a mask set used for a unit region. On the other hand, image data to be printed on the unit regions are stored in a print buffer. There, image data stored in the print buffer is singly picked based on the mask pattern being set in the RAM, and printing is performed in accordance with this picked image data. The above described selection of a mask set is performed for every unit region, whereby a mask set to be used is changed for each unit region.

This random selection of a mask set for each unit region enables unique setting of a mask set for each of the unit regions. Thereby, cyclic unevenness occurring over plural unit regions which are aligned side by side in the sub scanning direction can be reduced as compared to a case where one mask set is used continuously over the plural unit regions.

Note that, while seven varieties of mask sets are prepared in FIG. 7, the number of the varieties is not limited to 7. That is, the number of the varieties may be 1, any one of 2 to 6, or 8 or more. As the number of the varieties is larger, a wider selection of mask sets becomes available, whereby randomness of mask patterns used for the respective unit regions can be enhanced.

Figure 8:
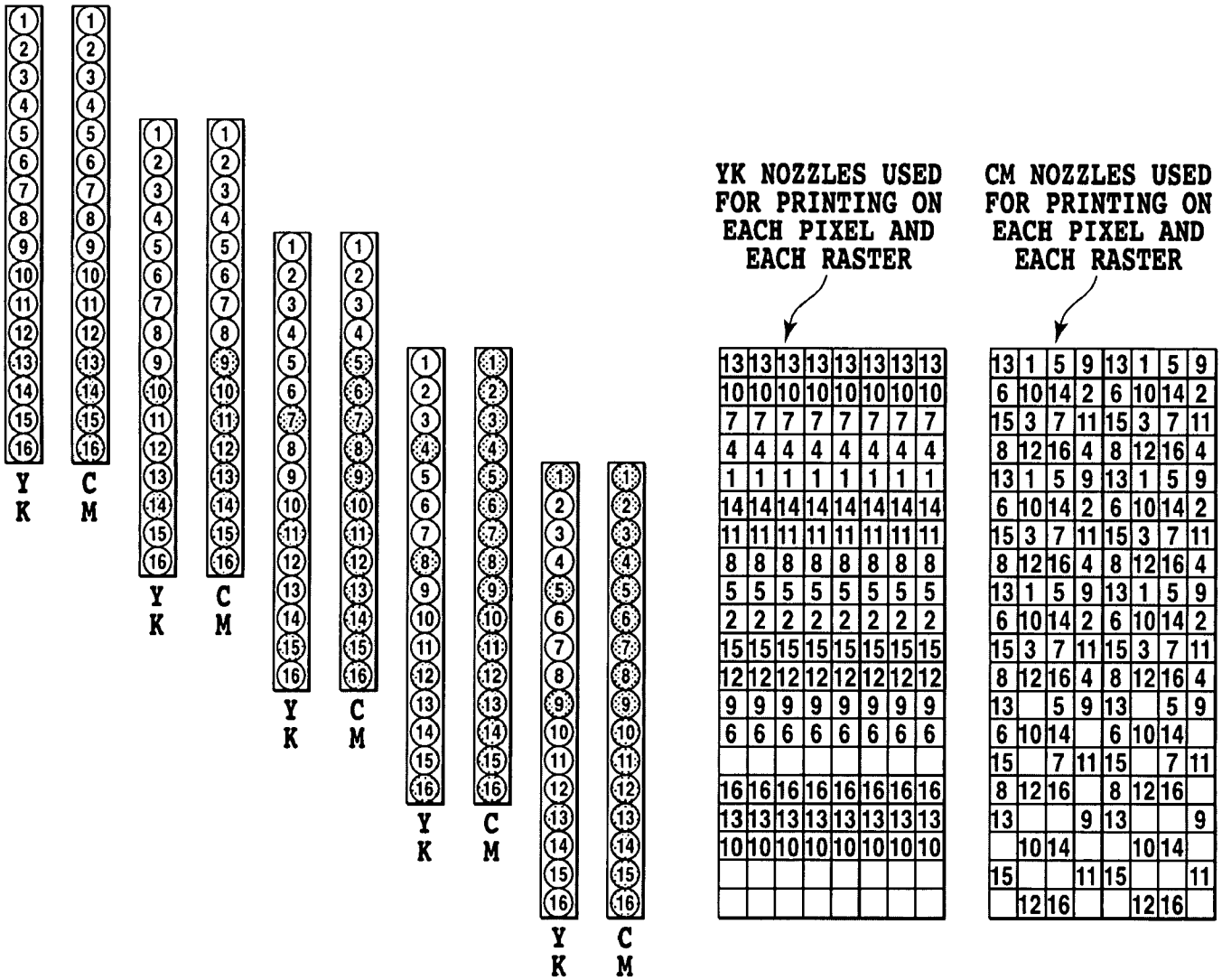
FIG. 8 is a diagram showing a state where the both printing modes in the first embodiment of the present invention are simultaneously carried out.

FIG. 8 is a diagram showing a case where the above described first and second printing modes are simultaneously executed. As shown in FIG. 8, simultaneous execution of the both printing modes is made possible by making positions of nozzle usable for printing with the yellow and black inks having small gloss values different from positions of nozzles usable for printing with the cyan and magenta inks having small gloss values. Note that the masks in FIGS. 5 and 6 are used as means for making the positions of the usable nozzle different.

The yellow and black inks are printed by the interlace mode in accordance with the mask patterns shown in FIG. 5. By using the mask patterns shown in FIG. 5, the number of nozzles usable for printing on one raster region is constrained to only 1, and, as a result, printing on one raster region is performed with one scanning pass. On the other hand, the cyan and magenta inks are printed by the multi-scan mode in accordance with the mask patterns shown in FIG. 6. By using the mask patterns shown in FIG. 6, the number of nozzles usable for printing on one raster region is increased to 4, and, as a result, printing on one raster region is performed with four scanning passes. As has been described above, differences in gloss value of an image printed with inks having different gloss values can be reduced because the interlace mode suitable for increasing a gloss value of an image is used for printing of an ink having a small gloss value, and the multi-scan mode in which a gloss value of an image tends to become small is used for printing of an ink having a great gloss value. Thereby, glossiness unevenness occurring due to differences in gloss value among inks can be reduced.

Figure 9:
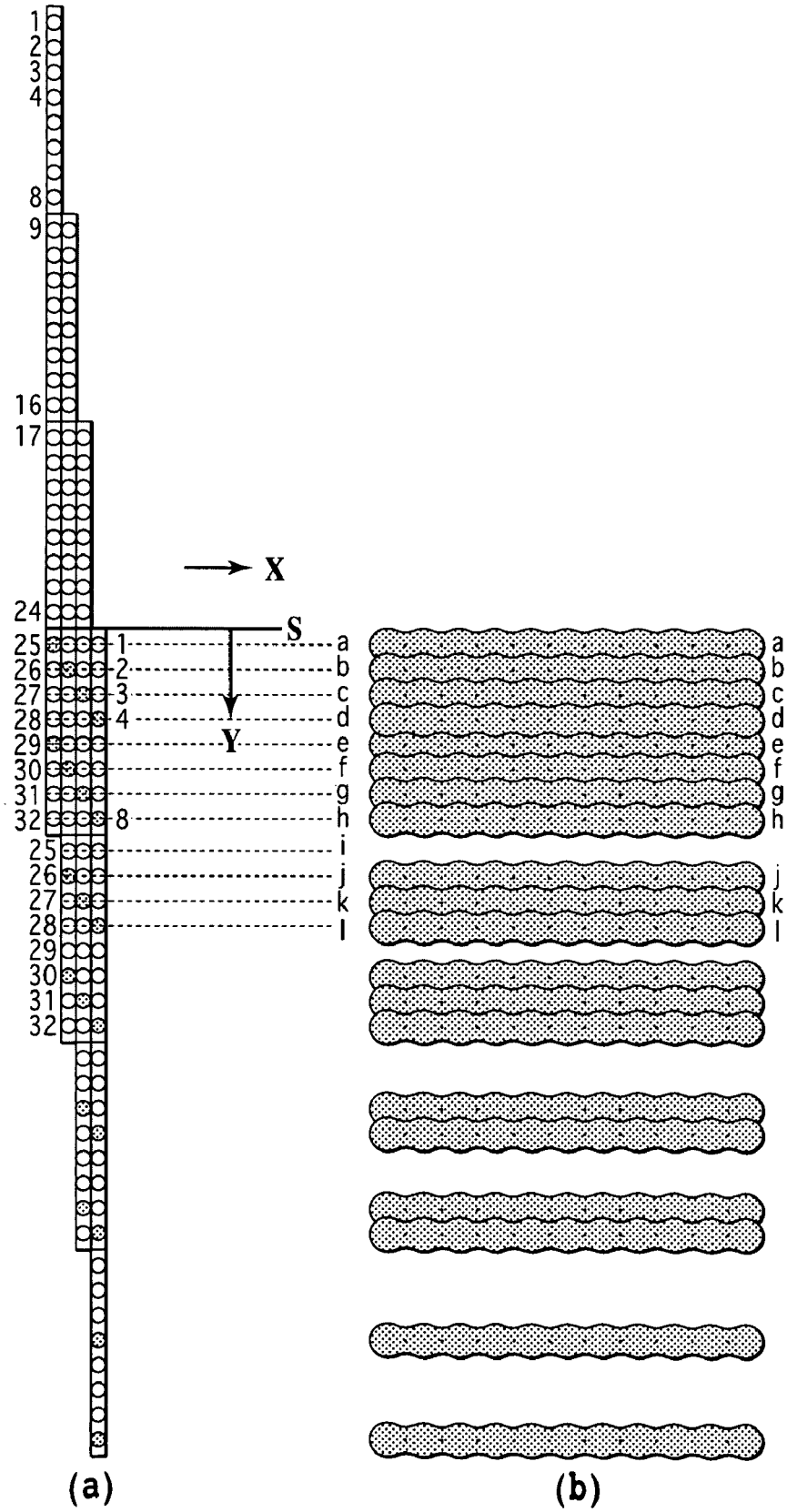
FIG. 9 is a view showing an ejection unit and a printed result in a case where printing is performed by an interlace mode in the first embodiment of the present invention.

FIG. 9 is a view showing an ejection unit and a printed result in a case where printing is performed by the interlace printing mode. A case where solid printing is performed through four-pass printing by use of the yellow ink having a relatively small gloss value will be described.

Reference (a) of FIG. 9 schematically shows the ejection unit of the printing head. Here, 32 ejection orifices are set as one block, and the block is divided into four parts each including eight ejection orifices. A direction indicated by an arrow X is the main scanning direction, a direction indicated by an arrow Y is the sub scanning direction, and printing with the yellow ink is started from a position indicated by a solid line S. First pass, second pass, third pass and fourth pass are shown from left to right in (a), and ejection orifices, in the passes, from which the yellow ink is ejected are marked out. Broken lines a to 1 indicate tracks (rasters or pixel arrays) formed after the ejection orifices pass, that is, hypothetical lines on which ink droplets are supposed to land, at the time when printing is performed with the ejection orifices moving in the main scanning direction.

First of all, when a print paper sheet is transferred and reaches a predetermined print start position, printing in the first pass is started. In the first pass, the yellow ink is ejected from ejection orifices 25 and 29 while the printing head moves in the main scanning direction. The yellow ink ejected from the ejection orifice 25 is continuously printed on the raster a, and the yellow ink ejected from the ejection orifice 29 is continuously printed on the raster e. After the completion of printing in the first pass, the print paper sheet is transferred in the sub scanning direction by an amount corresponding to a width of the one block.

Next, in the second pass, the yellow ink is ejected from ejection orifices 18, 22, 26 and 30 while the printing head moves in the main scanning direction. The yellow ink ejected from the ejection orifices 18, 22, 26 and 30 is continuously printed on the rasters b, f, j and an unillustrated raster n, respectively. After the completion of printing in the second pass, the print paper sheet is transferred in the sub scanning direction by the amount corresponding to the width of the one block.

Likewise, in the third pass, the yellow ink is ejected from ejection orifices 11, 15, 19, 23, 27 and 31, and is continuously printed on the rasters c, g and k and unillustrated rasters o, s and w, respectively. Thereafter, the print paper sheet is transferred in the sub scanning direction by the amount corresponding to the width of the one block.

With the completion of printing in the fourth pass, the printing head have scanned the same print region of the print paper sheet four times, whereby printing on the same print region (a region corresponding to the rasters a to h) ends.

Reference (b) of FIG. 9 is a view schematically showing how ink droplets are printed by the interlace mode described by use of (a). As shown in (b), dots printed on the same raster in one printing scan smoothly connect to one another. In the interlace mode, after a first dot is landed on a print sheet paper, a subsequent second dot adjacent to the first dot in the scanning direction lands thereon before the first dot penetrates the print sheet paper and is dried up. For this reason, the second dot smoothly connects to the first dot which is still in liquid state, and spreads on the print paper sheet so as to be flat and smooth. Since this operation is sequentially repeated, dots connect very smoothly to one another in the main scanning direction, whereby a highly glossy appearance can be obtained. Furthermore, rasters are also connected smoothly because the ink is still slightly in liquid state when printing is performed on a subsequent one of the rasters. Thereby, a highly glossy appearance can be obtained.

In contrast, in the multi-scan mode, such as one described in connection with FIG. 6, which uses masks which may make dots separated from one another, dots are dried before they connect to each other. There, when a second dot lands, irregularities appear on an image surface more or less. For this reason, a gloss value as great as that in the interlace mode for performing printing on the same raster with one time of printing scanning cannot be obtained.

As has been described above, in this embodiment, an ink having a relatively small gloss value is printed by the interlace mode suitable for enhancing a gloss value of an image. On the other hand, an ink having a relatively great gloss value is printed by the multi-scan mode in which a gloss value of an image tends to become smaller. Thereby, a difference between a gloss value of an image printed with an ink having a relatively small gloss value and a gloss value of an image printed with an ink having a relatively great gloss value can be reduced. As a result, when a printed image is printed by use of plural inks having different gloss values, a printed matter having a small degree of glossiness unevenness can be obtained.

Note that, although a case of using four inks that are CMYK has been exemplified above, inks applicable in this embodiment are not limited to the above. This embodiment only needs to use at least two inks, and this embodiment is also applicable, for example, in a case where a monochrome mode using two black-based inks, a black ink and a gray ink, is executed. In this case, for example, the black ink is set as an ink (the first ink) having a relatively small gloss value, and the gray ink is set as an ink (the second ink) having a relatively great gloss value, whereby, while the black ink is printed by the interlace mode, the gray ink is printed by the multi-scan mode.

Second Embodiment

The first embodiment is configured to simultaneously execute the interlace printing mode and the multi-scan printing mode. However, the present invention is not limited to such an embodiment, and may be configured to selectively execute the interlace printing mode and the multi-scan printing mode.

The printing apparatus according to this embodiment is configured so that the interlace printing mode and the multi-scan printing mode may be selectively executable. More specifically, the printing apparatus according to this embodiment selects, for printing an image, one of the interlace printing mode and the multi-scan printing mode, in accordance with the numbers of dots of inks constituting the image.

Figure 10:
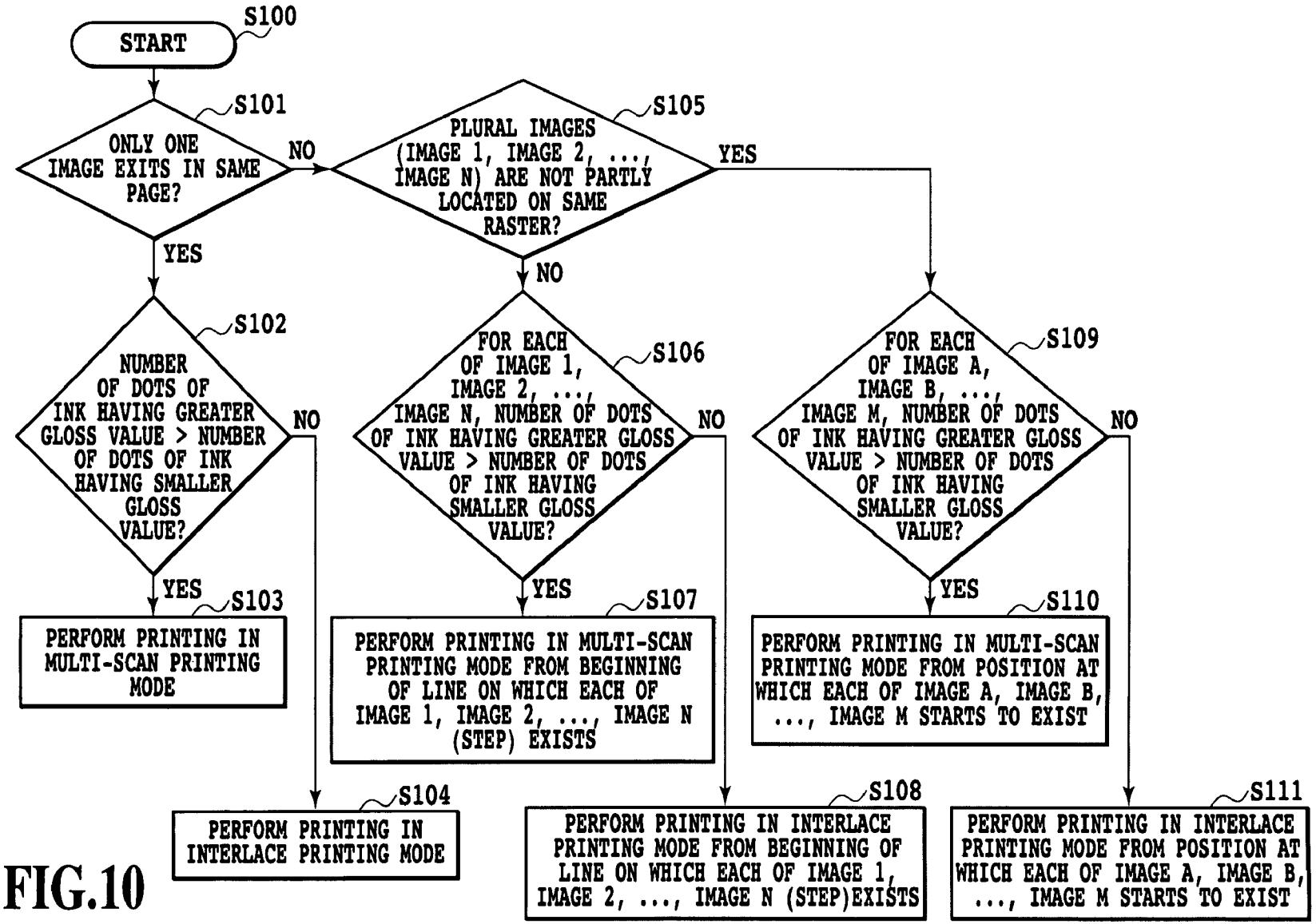
FIG. 10 is a flowchart showing a selection processing of printing modes in a second embodiment of the present invention.

FIG. 10 is a flowchart explaining a selection method of the printing modes in this second embodiment. First of all, steps therefor are started upon receipt of image data from a host computer (step S100). Then, judgment is made whether or not there is only one image exiting in the same page (step S101). If judgment is made that there is only one image in the same page, the step proceeds to step S102.

In step S102, the number of dots of inks having greater gloss values and the number of dots of inks having smaller gloss values are counted, and then compared to each other. In this embodiment, the numbers of dots of a cyan ink and a yellow ink are counted. The cyan ink in this embodiment has a greater gloss value than the yellow ink. Therefore, if the number of dots of the cyan ink is larger than the number of dots of the yellow ink, printing is performed by the multi-scan printing mode (step S103). On the other hand, if the number of dots of the cyan ink is smaller than that of the yellow ink, printing is performed by the interlace printing mode (step S104).

If two or more images exist in the same page in step S101, the step proceeds to step S105. In step S105, judgment is made whether or not the plural images judged to be present in step 101 are partly located on the same raster. If the plural images are not partly located on the same raster, that is, if all of the images are separate from one another in a transferring direction of a print medium, the step proceeds to step S106.

In step S106, for each of the plural images, the number of dots of inks having greater gloss values and the number of dots of inks having smaller gloss values are counted, and then compared to each other. If the number of dots of the cyan ink is larger than the number of dots of the yellow ink, printing is performed by the multi-scan printing mode from the beginning of a line in which the each of the images exists (step S107). On the other hand, if the number of dots of the cyan ink is smaller than the number of dots of the yellow ink, printing is performed by the interlace printing mode from the beginning of the line in which the each of the images exists (step S108).

If judgment is made in step S105 that the plural images judged to be present in step S101 are partially located on the same raster, that is, if any two or more of the plural images are not separate from one another in the transferring direction of a print medium, the step proceeds to step S109.

In step S109, for each of the plural images, the number of dots of inks having greater gloss values and the number of dots of inks having smaller gloss values are counted, and then compared to each other. If the number of dots of the cyan ink is larger than the number of dots of the yellow ink, printing is performed by the multi-scan printing mode from a position at which the corresponding images exists (step S110). On the other hand, if the number of dots of the cyan ink is smaller than the number of dots of the yellow ink, printing is performed by the interlace printing mode from the position in which the corresponding images exists (step S111). That is, even if the image starts in the middle of a line, the image forming is started from the starting position of an image with a corresponding printing mode by switching between the multi-scan printing mode and the interlace mode.

As has been described above, if the number of dots of inks having greater gloss values is larger, printing is performed by the multi-scan printing mode, whereas, if the number of dots of inks having greater gloss values is smaller, printing is performed by the interlace mode. By thus performing printing with a corresponding printing mode by switching between the multi-scan printing mode and the interlace printing mode, reduction of glossiness unevenness can be achieved.

In this embodiment, whether the multi-scan printing mode or the interlace printing mode is used in performing printing is judged by counting, and comparing to each other, the number of dots of inks having greater gloss values and the number of dots of inks having smaller gloss values. However, this embodiment is limited to a configuration in which the judgment is made by comparison between the numbers of dots of inks. This embodiment only needs to have a configuration in which the judgment is made by comparison between amounts of ink ejected in a unit area in which an image is printed.

Although a case of using the cyan ink and the yellow ink has been exemplified above, this embodiment is not limited to these inks. That is, inks having different gloss values are applicable. For example, a magenta ink and a black ink can be applied. The magenta ink has a relatively great gloss value as compared to the black ink. Therefore, if judgment is made that the number of dots of the magenta ink is larger, printing is performed by the multi-scan printing mode. On the other hand, if the number of dots of the black ink is larger, printing is performed by the interlace printing mode. Thereby, even in a case where printing is performed with the magenta ink and the black ink which have different gloss values, a printed matter having a small degree of glossiness unevenness can be obtained.

Third Embodiment

In the above embodiments, description has been given of cases where the multi-scan printing mode and the interlace printing mode are executed by use of a printing head in which an array density of ejection orifices used for ejecting an ink having a relatively great gloss value, and an array density of ejection orifices used for ejecting an ink having a relatively small gloss value are the same. However, the present invention is not limited to such embodiments. This third embodiment is characterized in that the multi-scan printing mode and the interlace printing mode are simultaneously executed by use of a printing head in which an array density of ejection orifices used for ejecting an ink having a relatively great gloss value, and an array density of ejection orifices used for ejecting an ink having a relatively small gloss value are different.

A printing method according to this embodiment will be described below. In this embodiment, in the same manner as in the first embodiment, a cyan ink having a relatively great gloss value is printed by the multi-scan printing mode, and a yellow ink having a relatively small gloss value is printed by the interlace mode. However, one difference from the first embodiment is, as will be described later, in that an ejection orifice array density of a yellow ink ejection unit (FIG. 11) is configured to be one fourths of an ejection orifice array density of a cyan ink ejection unit (unillustrated). Additionally, the numbers of ejection orifices are different for the yellow ink and for the cyan ink, the number of ejection orifices of the yellow ink ejection unit is set to 36, and the number of ejection orifices of the cyan ink ejection unit is set to 9.

Figure 11:
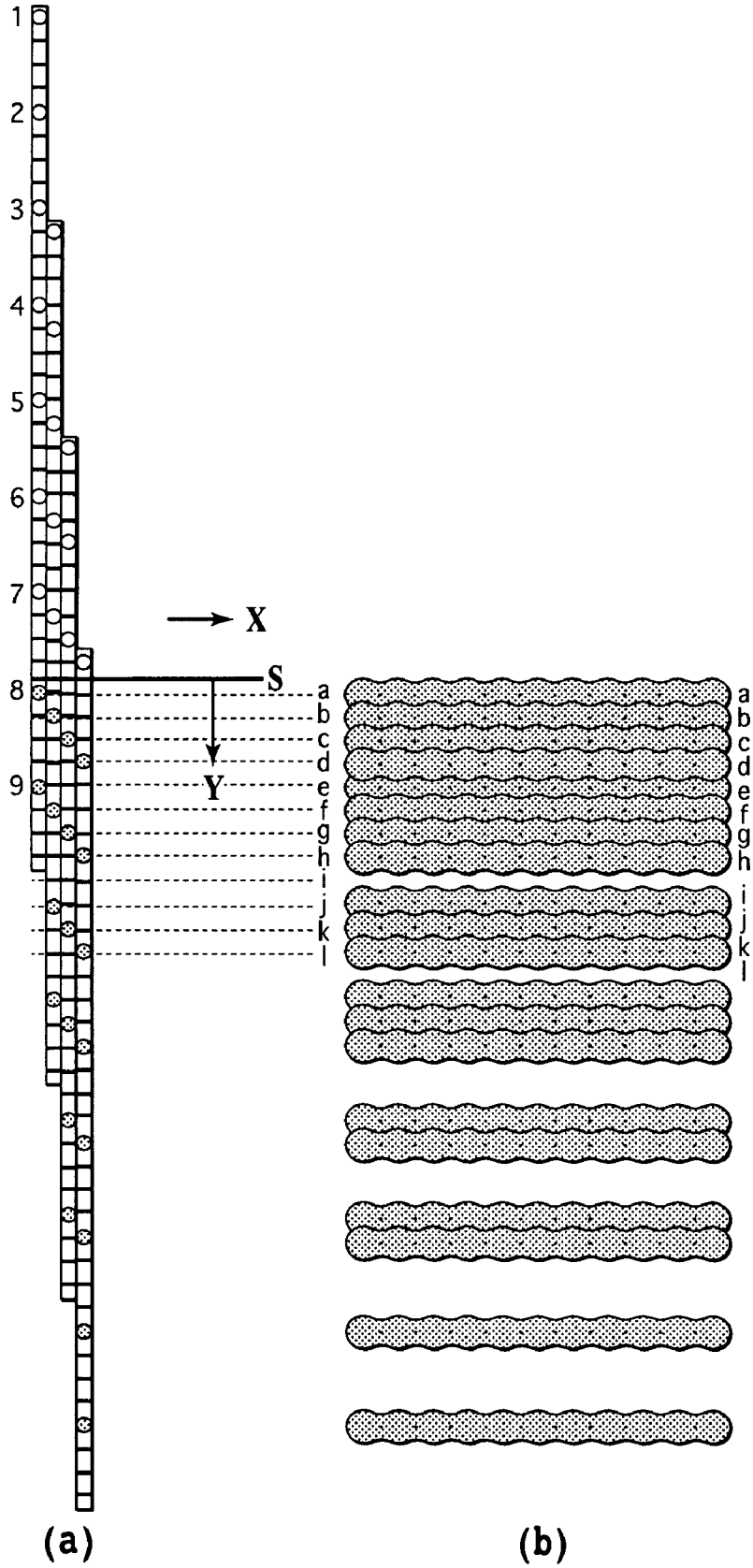
FIG. 11 is a view showing an ejection unit and a printed result in a case where printing is performed by an interlace printing mode in the third embodiment of the present invention.

FIG. 11 is view showing an ejection unit and a result of printing in a case where the printing is performed by the interlace printing mode with the yellow ink having a relatively small gloss value. Reference (a) of FIG. 11 schematically shows the yellow ink ejection unit. Each circle in (a) indicates an ejection orifice, and nine ejection orifices for the yellow ink exist here. One the other hand, a cross bar expresses a position (a hypothetical ejection orifice) at which an ejection orifice exists in the unillustrated cyan ink ejection unit, which no more exists in the yellow ink ejection unit. That is, in the unillustrated cyan ink ejection unit, the total of 36 ejection orifices exists at all of positions indicated by circles and positions indicated by crossbars. The ejection orifices and hypothetical ejection orifices are arrayed at regular intervals in a sequence shown in the (a). Consequently, the ejection orifice density in the yellow ink ejection unit is one fourths of the ejection orifice density in the cyan ink ejection unit. A direction indicated by an arrow X is a main scanning direction, a direction indicated by an arrow Y is a sub scanning direction, and printing with the yellow ink is started from a position indicated by a solid line S. First pass, second pass, third pass and fourth pass are shown from left to right in (a), and ejection orifices, in the paths, from which the yellow ink is ejected are marked out. Dotted lines a to l indicate tracks (rasters) formed after the ejection orifices pass, that is, hypothetical lines on which ink droplets are supposed to land, at the time when printing is performed with the ejection orifices moving in the main scanning direction.

First of all, when a print paper sheet is transferred and reaches a predetermined print start position, printing in the first pass is started. In the first pass, the yellow ink is ejected from ejection orifices 8 and 9 while the yellow ink ejection unit moves in the main scanning direction. The yellow ink ejected from the ejection orifice 8 is continuously printed on the raster a, and the yellow ink ejected from the ejection orifice 9 is continuously printed on the raster e. After the completion of printing in the first pass, the print paper sheet is transferred in the sub scanning direction by a length corresponding to a width equal to a nine ejection-orifice distance of the cyan ink ejection unit.

Next, in the second pass, the yellow ink is ejected from ejection orifices 6 and 7 while the yellow ink ejection unit moves in the main scanning direction. The yellow ink ejected from the ejection orifices 6 and 7 is continuously printed on the rasters b and f, respectively. After the completion of printing in the second pass, the print paper sheet is transferred in the sub scanning direction by the length corresponding to the width equal to the nine ejection-orifice distance of the cyan ink ejection unit.

Likewise, in the third pass, the yellow ink is ejected from ejection orifices 4 and 5, and is continuously printed on the rasters c and g, respectively. Thereafter, the print paper sheet is transferred in the sub scanning direction by the length corresponding to the width equal to the nine ejection-orifice distance of the cyan ink ejection unit.

With the completion of printing in the fourth pass, the printing head has scanned the same print region of the print paper sheet four times, whereby printing on the same print region (here, a region corresponding to the rasters a to h) ends.

Reference (b) of FIG. 11 is a view schematically showing how yellow ink droplets are printed by a printing method described by use of (a). The yellow ink having a relatively small gloss value is printed on one raster region by one-time scanning. As a result, yellow dots printed by one-time scanning on the same raster smoothly connect to one another, whereby a gloss value of a yellow image can be enhanced.

On the other hand, the cyan ink is printed by the multi-scan printing mode by means of the cyan ink ejection unit having a total of 36 ejection orifices at positions indicated by the circles and by the crossbars in (a). A transferring distance of a print paper sheet is set so as to be equal to the above described nine ejection-orifice distance. Then, printing is performed by use of ejection orifices 28 to 36 in the first pass, by use of ejection orifices 19 to 27 in the second pass, by use of ejection orifices 11 to 18 in the third pass, and by use of ejection orifices 1 to 9 in the fourth pass. Thereby, at the same time as printing is performed with four scanning passes on the same print region (here, the region corresponding to the rasters a to h), printing is performed with four scanning passes on each single raster region. As a result, an image printed of cyan dots printed on the same raster through four-times scanning has relatively large irregularities. Therefore, a gloss value of the cyan image can be reduced.

As has been described above, even the yellow ink ejection unit and in the cyan ink ejection unit has different ejection orifice array densities, the ink having a relatively great gloss value can be printed by the multi-scan printing mode, and the yellow ink having a relatively small gloss value can be printed by the interlace mode. As a result, a gloss value difference between a gloss value of an image printed with the ink having a relatively small gloss value and that having a relatively great gloss value can be reduced, whereby glossiness unevenness attributable to a gloss value difference between the inks can be reduced.

Example 1

In this example, a cyan ink (BCI-1421 C) and a yellow ink (BCI-1421 Y) were alternately printed to be in bands of cyan, yellow, cyan, yellow and so on, so as to form a solid image, the bands each having a width of about several millimeters. Here, in accordance with the method described in the first embodiment, the yellow ink having a relatively small gloss value was printed by the interlace mode, and the cyan ink having a relatively great gloss value was printed by the multi-scan printing mode. Then, glossiness of the solid image thus printed was visually examined, and glossiness unevenness was not perceived.

Example 2

In this example, printing was performed in accordance with the method described in the second embodiment by use of a magenta ink (BCI-1421 M) and a black ink (BCI-1421 Bk). The magenta ink has a relatively great gloss value as compared to the black ink. Therefore, when the number of dots of the magenta ink was judged to be larger than that of the black ink, printing was performed by the multi-scan printing mode, whereas, when the number of dots of the black ink was judged to be larger than that of the magenta ink, printing was performed by the interlace mode. Then, glossiness of each image thus printed was visually examined, and glossiness unevenness was not perceived.

Example 3

In this example, a cyan ink (BCI-1421 C) and a yellow ink (BCI-1421 Y) were alternately printed to be in bands of cyan, yellow, cyan, yellow and so on, so as to form a solid image, the bands each having a width of about several millimeters. Here, in accordance with the method described in the third embodiment, the yellow ink having a relatively small gloss value was printed by the interlace mode, and the cyan ink having a relatively great gloss value was printed by the multi-scan printing mode. Then, glossiness of the solid image thus printed was visually examined, and glossiness unevenness was not perceived.

Comparable Example

With a cyan ink (BCI-1421 C) and a yellow ink (BCI-1421 Y), solid printing at a duty of 100% was performed on glossy paper LFM-GP421R by the multi-scan printing mode by use of the random mask patterns shown in FIG. 4.

A print pattern was printed so as to form a solid image, in the same manner as in Example 1 described above, using a cyan ink (BCI-1421 C) and a yellow ink (BCI-1421 Y) alternately printed to be in bands of cyan, yellow, cyan, yellow and so on, the bands each having a width of about several millimeters. Then, glossiness of this pattern was visually examined. As a result, glossiness unevenness considered to be attributable to a gloss value difference between cyan and yellow is concerned, and a glossiness feel thereof brought discomfort.

The above examination results of Examples 1 to 3 and Comparable Example can be summarized in a table as follows.

TABLE 1

| | Example 1 | Example 2 | Example 3 | Comparable Example |
|---|---|---|---|---|
| Assessment result on glossiness feel | Good | Good | Good | poor |

(Note: "Good" means that a glossiness feel did not bring discomfort, and "poor" means that a glossiness feel brought discomfort.)

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-106078, filed Apr. 15, 2008, which is hereby incorporated by reference herein in its entirety.

What is claimed is:

1. An inkjet printing apparatus for forming an image on a print medium by relatively scanning a first ejection unit for ejecting a first ink and a second ejection unit for ejecting a second ink which is a different kind from the first ink to the print medium, comprising:

a selection unit configured to select any one of a first printing mode for completing an image to be formed with the first and second inks to a pixel array region on the print medium by scanning the first and second ejection units one time and a second printing mode for completing an image to be formed with the first and second inks to the pixel array region on the print medium by scanning the first and second ejection units plural times, wherein the selection unit selects the first printing mode on condition that an amount of the second ink to be used for forming the image is not larger than an amount of the first ink to be used for forming the image, and selects the second printing mode on condition that the amount of the second ink to be used for forming the image is larger than the amount of the first ink to be used for forming the image, and a gloss value of a solid image with the second ink is greater than a gloss value of a solid image with the first ink.

2. The inkjet printing apparatus according to claim 1, wherein a judgment on whether or not the amount of the second ink to be used for forming the image is larger than the amount of the first ink is made by comparison between the number of dots of the first ink and the number of dots of the second ink.

3. An inkjet printing method for forming an image on a print medium by relatively scanning a first ejection unit for ejecting a first ink and a second ejection unit for ejecting a second ink which is a different kind from the first ink to the print medium, comprising the steps of:

judging whether or not an amount of the second ink used for forming the image is larger than an amount of the first ink used for forming the image; and completing the image to be formed with the first and second inks to a pixel array region on the print medium by scanning the first and second ejection units one time on condition that the amount of the second ink is not larger than the amount of the first ink, and completing the image to be formed with the first and second inks to the pixel array region on the print medium by scanning the first and second ejection units plural times on condition that an amount of the second ink is larger than an amount of the first ink, wherein a gloss value of a solid image with the second ink is greater than a gloss value of a solid image with the first ink.

* * * * *